US005431751A

United States Patent [19]

Okochi et al.

[11] Patent Number: 5,431,751

[45] Date of Patent: Jul. 11, 1995

[54] HIGH STRENGTH ALUMINUM ALLOY

[75] Inventors: Yukio Okochi; Kazuaki Sato; Tetsuya Suganuma, all of Susono; Akira Kato, Sendai; Tsuyoshi Masumoto, Sendai; Akihisa Inoue, Sendai, all of Japan

[73] Assignee: Toyota Jidosha Kabushiki Kaisha, Japan

[21] Appl. No.: 13,980

[22] Filed: Feb. 5, 1993

[30] Foreign Application Priority Data

Feb. 7, 1992 [JP] Japan ..... 4-022497

[51] Int. Cl.[6] ..... C22C 21/00; C22C 21/12

[52] U.S. Cl. ..... 148/437; 148/539; 148/549; 148/551; 148/403; 148/438; 420/529; 420/538; 420/550; 420/551; 420/552; 420/553

[58] Field of Search ..... 148/539, 549, 551, 403, 148/437, 438; 420/529, 538, 550, 551, 552, 553

[56] References Cited

U.S. PATENT DOCUMENTS 5,053,085 10/1991 Masumoto et al. ..... 148/437
5,074,935 12/1991 Masumoto et al. ..... 148/403

FOREIGN PATENT DOCUMENTS

0339676A1 2/1989 European Pat. Off. .
0460887A1 11/1991 European Pat. Off. .
64-47831 2/1989 Japan .
1-275732 11/1989 Japan .
3-72048 3/1991 Japan .
3-100130 4/1991 Japan .

OTHER PUBLICATIONS

"A Dictionary of Metallurgy", A. D. Merriman. MacDonald & Evans, Ltd., London (1958); p. 190.

Physical Properties of Amorphous $Al_{90}Fe_5Ce_5$, J. Phys. Condens. Matter 2 (Dec. 1990), 4315–4324.

Atomic Structure of Amorphous $Al_{90}Fe_xCe_{10-x}$, J. Mater. Res., vol. 5, No. 12, Dec. 1990, 2807–2812.

Production and Properties of Light-Metal-Based Amorphous Alloys, Materials Science and Engineering, A133 (Dec. 1991)6–9.

*Primary Examiner*—Sam Silverberg
*Assistant Examiner*—Robert R. Koehler
*Attorney, Agent, or Firm*—Finnegan, Henderson, Farabow, Garrett & Dunner

[57] ABSTRACT

A high strength aluminum alloy is expressed by a general formula, $Al_aX_bMm_c$, in which "X" stands for at least one element selected from the group consisting of Ti, V, Cr, Mn, Fe, Co, Ni, Cu and Zr, "Mm" stands for a misch metal, a content "a" of aluminum falls in a range of from 95.2 to 97.5 atomic %, and a content "b" of "X" and a content "c" of the "Mm" fall in a hatched area enclosed by points "A," "B," "C" and "D" of accompanying FIG. 1 on atomic % basis, and whose metallic phase includes microcrystalline phases or mixed phases containing amorphous phases in a volume content of less than 50% and the balance of microcrystalline phases. As a result, the amorphous phases or the microcrystalline phases are dispersed uniformly in its base microcrystalline phases appropriately, and at the same time the thus generating base microcrystalline phases are reinforced by forming solid solutions including the "Mm" and the transition metal element "X" as well. Hence, the high strength aluminum alloy comes to have a low specific gravity and a high strength which have not been available from conventional Al amorphous alloys.

9 Claims, 1 Drawing Sheet

HIGH STRENGTH ALUMINUM ALLOY

BACKGROUND OF THE INVENTION

1. Field of the Invention

The present invention relates to a high strength aluminum alloy whose metallic phase includes microcrystalline phases or amorphous phases mingling with microcrystalline phases.

2. Description of the Related Art

An amorphous alloy is defined as an alloy whose arrangement of the constituent atoms does not have the crystal-like long periodic regularity. In general, the amorphous alloy can be produced by rapidly quenching of a molten alloy, electrolyticaly depositing or sputtering. Regarding the physical properties, the amorphous alloy has been known that it has a wider variety of excellent physical properties than the corresponding crystalline alloy does.

In an Al alloy, it has been known well that the amorphous alloy can be obtained. For instance, as a metal-metal amorphous alloy, there has been an Al-Ln binary alloy in which "Ln" stands for Y, La, Ce, Pr, Nd, Pm, Sm, Eu, Gd, Tb, Dy, Ho Er, Tm, Yb and Lu, or an Al-Ln-TM ternary alloy in which "TM" stands for V, Nb, Mo, Mn, Fe, Co and Ni.

In the Al-Ln binary alloy, the Vickers hardness (Hv) and the tensile strength ($\sigma f$) enlarge as the content of the "Ln" increases. In the Al-Ln binary amorphous alloy, the maximum values of the Vickers hardness (Hv) and the tensile strength ($\sigma f$) are 250 and 875 MPa, respectively. Further, in the Al-Ln-TM ternary amorphous alloy, a higher mechanical strength is available. For instance, in an Al-Ln-Ni ternary amorphous alloy, the maximum values of the Vickers hardness (Hv) and the tensile strength ($\sigma f$) are 340 and 1,140 MPa, respectively. These maximum values exhibited by the Al-Ln-Ni ternary amorphous alloy remarkably exceed those exhibited by an Al crystalline alloy, e.g., 180 and 550 MPa. Thus, it is apparent that the Al amorphous alloys have excellent mechanical properties.

In Japanese Unexamined Patent Publication (KOKAI) No. 1-275,732, a composite substance is disclosed which includes amorphous phases or amorphous phases and microcrystalline phases and which has a tensile strength of from 87 to 103 kgf/mm$^2$ (from 853.6 to 1,011 MPa ) and a yield strength of from 82 to 96 kgf/mm$^2$ (from 804.6 to 941.9 MPa). The composite substance can be obtained by rapidly quenching and solidifying a ternary alloy expressed by a general formula, $Al_aM_bX_c$, in which "M" stands for one or more metal elements selected from the group consisting of V, Cr, Mn, Fe, Co, Ni, Cu, Zr, Ti, Mo, W, Ca, Li, Mg, Si and Nb, "X" stands for one or more metal elements selected from the group consisting of Y, La, Ce, Sm, Nd, Hf, Ta and "Mm" (i.e., a misch metal), a content "a" falls in a range of from 50 to 95 atomic %, a content "b" falls in a range of 0.5 to 35 atomic %, and a content "c" falls in a range of 0.5 to 25 atomic %.

As earlier mentioned, in the Al-Ln-Ni ternary amorphous alloy, the superb mechanical strengths are available. Moreover, according to the 30th research paper by the 147th amorphous material committee of the Japan Society for the Promotion of Science, a research has been conducted on a quarternary alloy which includes $Al_{88}Ni_{10}Y_2$ as the principal component and in which a part of the Ni elements are substituted by Mn, Fe, Co, Zr or the like. For instance, in an $Al_{88}Ni_5Y_2Fe_5$ amorphous alloy, a higher tensile strength of 1,400 MPa can be obtained. In an $Al_{88}Ni_8Y_2Mn_2$ amorphous alloy, a further higher tensile strength of 1,470 MPa can be obtained.

As having been described so far, the Al amorphous alloys or the alloys including the composite substance made of the amorphous phases and the microcrystalline phases have the tensile strength or the hardness which is twice that of the conventional Al crystalline alloy. The present inventors further investigated the specific gravity of the Al amorphous alloys and compared them with that of the other crystalline or amorphous alloys. The results of the investigation and comparison are summarized in Table 1 below.

TABLE 1

| Phase | Composition (in atomic %) | Form | Specific Gravity | Tensile Strength (MPa) |
|---|---|---|---|---|
| Crystalline | Al—Zn—Mg—Cu | Forged Substance | 2.8 | 550 |
| Crystalline | Al—Si—Fe—Cu—Mg | Extruded Substance | 2.9 | 700 |
| Amorphous | $Al_{88}Fe_9Mm_3$ | Ribbon | 3.3 | 870 |
| Amorphous | $Al_{88}Ni_8Mn_2Y_2$ | Ribbon | 3.2 | 1,500 |
| Amorphous | $Al_{88}Ni_7Fe_3Y_2$ | Ribbon | 3.2 | 1,410 |

As can be readily appreciated from Table 1, the Al amorphous alloys have the large specific gravity. For instance, the $Al_{88}Ni_8Mn_2Y_2$ alloy, i.e., the Al quarternary amorphous alloy, whose tensile strength is the highest has the specific gravity of 3.2, and the $Al_{88}Fe_9Mm_3$ alloy has the specific gravity as large as 3.3. On the other hand, the conventional crystalline forged substance and the conventional extruded substance, i.e., the Al-Zn-Mg-Cu crystalline alloy and the Al-Si-Fe-Cu-Mg crystalline alloy, have the specific gravity as small as from 2.8 to 2.9, but they have the lower tensile strength, e.g., 700 MPa at the highest.

The reason for the large specific gravity of the conventional Al amorphous alloys is that they contained Fe, Ni, Mn or the like which have a larger specific gravity than Al does. Hence, it has been longed for an Al amorphous alloy which has a much lower specific gravity but which keeps the high tensile strength in order to reduce the weight of aircraft, automobiles or the like and improve the low-fuel consumption thereof.

The present invention has been developed in view of the aforementioned problem of the conventional Al amorphous alloys, i.e., the large specific gravity. It is therefore an object of the present invention to provide a novel Al amorphous alloy which has a much lower specific gravity than the conventional Al amorphous alloys do but which keeps the high tensile strength thereof.

SUMMARY OF THE INVENTION

The present inventors thought of increasing the atomic percentage of Al as much as possible in ternary alloys including Al, a lanthanide element (hereinafter simply referred to as "Ln") and a transition metal element (hereinafter simply referred to as "TM"), i.e., Al-Ln-TM ternary alloys, in order to reduce the specific gravity. Further, they intended to maintain the amorphous phase forming ability in the Al-Ln-TM ternary alloys, optimize the structure thereof and keep the high strength thereof by adding the "Ln" and "TM" in minimum amounts, and they investigated a large variety of the "Ln" and "TM" and the minimum addition amounts thereof in order to fulfill the intention. Furthermore, they inquired into the actual applicabilities of the Al-Ln-TM ternary alloys such as the costs or the like.

As a result, the present inventors selected Ti, V, Cr, Mn, Fe, Co, Ni, Cu and Zr as the "TM," and they selected the "Mm" (i.e., a misch metal) as the "Ln." Further, in view of the fact that the high strength results from the dispersion of the amorphous phases in the microcrystalline phases in the Al-Ln-TM ternary alloys, they conducted a series of researches and developments in order to find the optimum content ranges of Ti, V, Cr, Mn, Fe, Co, Ni, Cu, Zr and the "Mm." By adding the "TM" and "Mm" in the optimum content ranges, the Al-Mm-TM alloy comes to include crystalline phases in which the amorphous phases or the microcrystalline phases are dispersed in an appropriate amount, and whose base structure is reinforced by solid solutions in an appropriate manner. The present inventors thus successfully completed an Al amorphous alloy which has a much lower specific gravity than the conventional Al amorphous alloys do, but which keeps the high tensile strength thereof.

A high strength aluminum alloy according to the present invention is expressed by a general formula, $Al_aX_bMm_c$, in which:

"X" stands for at least one element selected from the group consisting of Ti, V, Cr, Mn, Fe, Co, Ni, Cu and Zr;

"Mm" stands for a misch metal;

a content "a" of aluminum falls in a range of from 95.2 to 97.5 atomic %; and a content "b" of "X" and a content "c" of the "Mm" fall in a hatched area enclosed by points "A," "B," "C" and "D" of accompanying FIG. 1 on atomic % basis; and whose metallic phase includes microcrystalline phases or mixed phases containing amorphous phases in a volume content of less than 50% and the balance of microcrystalline phases.

In the present high strength aluminum alloy, the "Mm" stands for a misch metal. A misch metal is a generic name of a composite substance which includes La and Ce as the principal components, the rare-earth elements (or the lanthanide elements) other than La and Ce, and inevitable impurities (e.g., Si, Mg, Fe, Ag and the like). For example, the misch metal includes Ce in an amount of from 45 to 54% by weight, La in an amount of from 23 to 32% by weight, Nd in an amount of from 13 to 19% by weight, Pr in an amount of from 3 to 8% by weight, and Fe in an amount of less than 1% by weight, and other elements (or inevitable impurities) in an amount of less than 1% by weight.

In the present high strength aluminum alloy, the molten metals of the alloys having the aforementioned compositions are rapidly quenched and solidified by a rapid liquid quenching and solidifying process in order to obtain the mixed phases including the amorphous phases and the microcrystalline phase or the microcrystalline phases. The rapid liquid quenching and solidifying process involves a process in which molten metals or alloys are quenched rapidly. Thus, the molten metals or alloys are super-cooled, and accordingly the structure of the metals or alloys is frozen so as to obtain the amorphous phases. As the rapid liquid quenching and solidifying process, the following are available. A gun process or a piston-anvil process which can produce thin tips having a weight of hundreds milligrams, a centrifugal process, a single roll process or a twin roll process which can produce thin strips continuously, a spray process which can produce powders, a submerged rotary spinning process which can produce fine wires, and so on.

In particular, the single roll process, the twin roll process and the submerged rotary spinning process are effective for producing the present high strength aluminum alloy. With these processes, it is possible to establish a quenching speed of from $10^4$ to $10^{6°}$ C./second. When producing thin strips by the single roll process or the twin roll process, the molten metals of the alloys having the aforementioned compositions are spouted through a nozzle opening onto a roll rotating at a predetermined speed range of from about 300 to 10,000 rpm. The roll is usually made of copper or steel in a diameter of from 30 to 300 mm. Thus, it is possible to produce thin amorphous strips in a width of from about 1 to 300 mm and in a thickness of from about 5 to 500 micrometers.

When producing fine amorphous wires by the submerged rotary spinning process, a quenching liquid is placed in a drum, and then the drum is rotated at a speed of from about 50 to 500 rpm. Accordingly, a quenching liquid layer is formed and maintained in a depth of from about 1 to 10 cm by the centrifugal forces in the drum. Finally, the molten metals of the alloys having the aforementioned compositions are spouted through a nozzle opening into the rotating quenching liquid layer by applying a back pressure in an argon gas atmosphere or the like.

When producing amorphous powders by the spray process, for instance, a pressurized molten metal spray process, a nitrogen gas, argon gas, helium gas or the like which is pressurized as high as from 40 to 100 kgf/cm$^2$ is sprayed onto the dripping molten metals of the alloys having the aforementioned compositions, and thereby the molten metals are quenched rapidly. Thus, it is possible to produce the present high strength aluminum alloy in amorphous powders.

In addition, other than the aforementioned rapid liquid quenching and solidifying processes, a PVD (i.e., physical vapor deposition) process such as a vacuum deposition process, a sputtering process, an ion plating process or the like, and a CVD (i.e., chemical vapor deposition) process such as a vapor phase chemical reaction process or the like can be utilized in order to obtain the amorphous phases or the microcrystalline phases.

It is possible to tell by a usual X-ray diffraction analysis whether the aluminum alloys produced by the rapid liquid quenching and solidifying processes include the mixed phases of the amorphous phases and the microcrystalline phases or the microcrystalline phases. Specifically speaking, when the amorphous phases are present, the X-ray diffraction chart exhibits the halo patterns which are inherent to the amorphous structures. When the composite substances of the amorphous phases and the microcrystalline phases are produced, the X-ray diffraction chart exhibits diffraction patterns which are the syntheses of the halo patterns resulting from the amorphous phases and the diffraction patterns resulting from the microcrystalline structures. Moreover, when the resulting alloys are amorphous, they can be determined as such because they generate heats at a crystallization temperature (Tx) or more. The heat generations can be detected with a DSC (i.e., differential scanning calorimeter).

The present high strength aluminum alloy has the Al content which is adjusted to from 95.2 to 97.5 atomic %, and accordingly it includes Al having a lighter specific gravity in such a larger content. As a result, the present high strength aluminum alloy is adapted to have a specific gravity of 3.0 or less.

Further, in the present high strength aluminum alloy, the "Mm" is selected as the lanthanide element "Ln" for constituting the Al amorphous alloys, and at least one of Ti, V, Cr, Mn, Fe, Co, Ni, Cu and Zr is selected as the transition metal element "X" therefor. Furthermore, the content "b" of the "Mm" and the content "c" of the transition metal "X" are adapted so as to fall in the hatched area enclosed by points "A," "B," "C" and "D" of accompanying FIG. 1 on atomic % basis. As a result, the amorphous phases or the microcrystals are dispersed uniformly in the base microcrystalline phases appropriately, and at the same time the thus generating base microcrystalline phases are reinforced by forming solid solutions including the "Mm" and the transition metal "X" as well. All in all, the present high strength aluminum alloy comes to have a low specific gravity and a high strength which have not been available from the conventional Al amorphous alloys.

Specifically speaking, in accompanying FIG. 1, the compositions of points "A," "B," "C" and "D" on atomic % basis are as follows: Point "A"; ("X," "Mm")=(0.5, 4.3), Point "B"; ("X," "Mm")=(0.5, 2.0), Point "C"; ("X," "Mm")=(1.5, 1.0), and Point "D"; ("X," "Mm")=(3.8, 1.0). Moreover, in accompanying FIG. 1, the compositions of points "E" and "F" on atomic % basis are as follows: Point "E"; ("X," "Mm") (2.0, 2.0), and Point "F"; ("X," "Mm")=(2.4, 2.4). As aforementioned, the transition metal "X" stands for at least one element selected from the group consisting of Ti, V, Cr, Mn, Fe, Co, Ni, Cu and Zr.

The reasons for limiting the content ranges of the components in the present high strength aluminum alloy will be hereinafter described.

First of all, aluminum is the principal component of the present high strength aluminum alloy, and it is compounded therein as much as possible in order to reduce the specific gravity. When the content of aluminum is less than 95.2 atomic the specific gravity cannot be reduced sufficiently. In addition, when amorphous ribbons are made from aluminum alloys having the aluminum content of less than 95.2 atomic %, the resulting amorphous ribbons are so brittle that the strength deteriorates. On the other hand, When the content of aluminum is more than 97.5 atomic %, the amorphous phases and the microcrystalline phases are hardly formed. Hence, the content of aluminum is limited so as to fall in the range of from 95.2 to 97.5 atomic %.

The "Mm" and the transition metal "X" increase the forming ability of the amorphous phases, and they also improve the strength of the resulting aluminum alloys. As aforementioned, the content "b" of the "Mm" and the content "c" of the transition metal "X" are limited so as to fall in the hatched area enclosed by points "A," "B," "C" and "D" of accompanying FIG. 1 on atomic % basis. This results from the facts that the resulting aluminum alloys have a specific gravity of 3.0 or less and a tensile strength of 900 MPa or more when the content "b" of the "Mm" and the content "c" of the transition metal "X" fall in the hatched area, and that the resulting aluminum alloys do not have the specific gravity of 3.0 or less and the tensile strength of 900 MPa or more simultaneously when the content "b" of the "Mm" and the content "c" of the transition metal "X" fall outside the hatched area. The resulting aluminum alloys, having the content "b" of the "Mm" and the content "c" of the transition metal "X" which fall in the hatched area, come to have the large tensile strength, because the amorphous phases are dispersed in the microcrystalline phases so as to strengthen the microcrystalline phases, and because the microcrystalline phases are reinforced by forming solid solutions including the "Mm" and the transition metal "X" as well.

Indeed, when the content of aluminum is less than 95.2 atomic %, the content "b" of the "Mm" is more than 4.3 atomic and the content "c" of the transition metal "X" is more than 3.8 atomic %, the resulting aluminum alloys include the amorphous phases in a larger content, however, they come to have a deteriorated tensile strength and at the same time an enlarged specific gravity. Moreover, when the content of aluminum is more than 97.5 atomic %, the content "b" of the "Mm" is less than 1.0 atomic % and the content "c" of the transition metal "X" is less than 0.5 atomic %, the resulting aluminum alloys come to have a deteriorated tensile strength because the solid solutions including the "Mm" and the transition metal "X" are formed so less that the microcrystalline phases are reinforced less.

In particular, it is preferable that the content "b" of the "Mm" and the content "c" of the transition metal "X" fall in a hatched area enclosed by points "A," "B," "E" and "F" of accompanying FIG. 1 on atomic % basis. When the content "b" of the "Mm" and the content "c" of the transition metal "X" fall in this hatched area, the resulting present high strength aluminum alloys more likely to be amorphous than do the present high strength aluminum alloys having the content "b" of the "Mm" and the content "c" of the transition metal "X" which fall in the other hatched area, and they come to have a further increased tensile strength.

Finally, the metallic phase is specified so as to include the microcrystalline phases, or the mixed phases which contain the amorphous phases in the volume content of less than 50% and the balance of the microcrystalline phases. Here, the microcrystalline phases mean phases which have a grain size of 0.2 micrometers or less. The limitation results from the fact that the microcrystalline phases occupy the metallic phase (or the structure) of the resulting aluminum alloys predominantly so that the ductility is improved during the plastic deformation, and that the resulting aluminum alloys come to have an increased tensile strength. It is further preferable that the volume content of the amorphous phases falls in a range of from 5 to 30% by volume.

As having been described so far, the present high strength aluminum alloy is adapted to have the Al content which falls in the range of from 95.2 to 97.5 atomic %, and accordingly it includes Al having a lighter specific gravity in such a larger content. As a result, the present high strength aluminum alloy can be produced to have a specific gravity of 3.0 or less.

Further, in the present high strength aluminum alloy, the "Mm" is selected as the lanthanide element "Ln" for constituting Al amorphous alloys, and at least one of Ti, V, Cr, Mn, Fe, Co, Ni, Cu and Zr is selected as the transition metal element "X" therefor. Furthermore, the content "b" of the "Mm" and the content "c" of the transition metal "X" are adapted so as to fall in the hatched area enclosed by points "A," "B," "C" and "D" of accompanying FIG. 1 on atomic % basis, preferably in the hatched area enclosed by points "A," "B," "E" and "F" of accompanying FIG. 1 on atomic % basis. As a result, the amorphous phases or the microcrystalline phases are dispersed uniformly in the base microcrystalline phases appropriately, and at the same time the thus generating base microcrystalline phases are reinforced by forming solid solutions including the "Mm" (i.e., the misch metal) and the transition metal element "X" (i.e., Ti, V, Cr, Mn, Fe, Co, Ni, Cu, Zr or the mixtures thereof) as well. All in all, the present high strength aluminum alloy comes to have a low specific gravity and a high strength which have not been available from the conventional Al amorphous alloys.

BRIEF DESCRIPTION OF THE DRAWINGS

A more complete appreciation of the present invention and many of its advantages will be readily obtained as the same becomes better understood by reference to the following detailed description when considered in connection with the accompanying drawings and detailed specification, all of which forms a part of the disclosure.

DETAILED DESCRIPTION OF THE PREFERRED EMBODIMENTS

Having generally described the present invention, a further understanding can be obtained by reference to the specific preferred embodiments which are provided herein for purposes of illustration only and are not intended to limit the scope of the appended claims.

Examples of the high strength aluminum alloy according to the present invention will be hereinafter described together with Comparative Examples, and the advantageous effects associated with the Examples will be verified accordingly. The following chemical components were prepared as set forth in Table 2 below, and they were melted by plasma melting so as to produce aluminum alloy button ingots of Examples 1 through 13 as well as Comparative Examples 14 and 15, respectively. Here, Examples 1 through 13 were the preferred embodiments of the present high strength aluminum alloy, and Comparative Examples 14 and 15 were the aluminum alloys whose compositions fell outside the claimed composition range and which could not be classified into the present high strength aluminum alloy.

TABLE 2

| No. | Composition (in atomic %) | Specific Gravity | Tensile Strength (in MPa) | Phase |
|---|---|---|---|---|
| Ex. 1 | 95.5Al—2.5Mm—2.0Mn | 2.9 | 1,100 | Mixed Phase |
| Ex. 2 | 95.5Al—2.8Mm—1.7V | 2.9 | 1,060 | Mixed Phase |
| Ex. 3 | 95.4Al—2.1Mm—2.5Cu | 2.9 | 1,000 | Mixed Phase |
| Ex. 4 | 96.0Al—2.5Mm—1.5Cr | 2.9 | 1,050 | Mixed Phase |
| Ex. 5 | 96.0Al—3.0Mm—1.0Fe | 2.9 | 1,120 | Mixed Phase |
| Ex. 6 | 95.5Al—3.4Mm—1.1Ti | 2.9 | 1,090 | Mixed Phase |
| Ex. 7 | 95.8Al—2.0Mm—0.9V—1.3Ni | 2.9 | 1,070 | Mixed Phase |
| Ex. 8 | 96.3Al—2.5Mm—1.2Ni | 2.9 | 1,060 | Mixed Phase |
| Ex. 9 | 96.5Al—2.5Mm—0.5Cu—0.5Co | 2.9 | 1,000 | Microcrystalline Phase |
| Ex. 10 | 96.5Al—1.7Mm—1.8Co | 2.9 | 960 | Microcrystalline Phase |
| Ex. 11 | 96.0Al—1.5Mm—2.5Fe | 2.9 | 950 | Microcrystalline Phase |
| Ex. 12 | 97.0Al—2.0Mm—1.0Fe | 2.9 | 1,000 | Microcrystalline Phase |
| Ex. 13 | 96.0Al—1.8Mm—2.2Zr | 2.9 | 970 | Microcrystalline Phase |
| Comp. Ex. 14 | 94.5Al—4.5Mm—1.0Fe | 3.1 | 700 | Mixed Phase |
| Comp. Ex. 15 | 98.0Al—1.0Mm—1.0Fe | 2.8 | 400 | Crystalline Phase |

Figure 3:
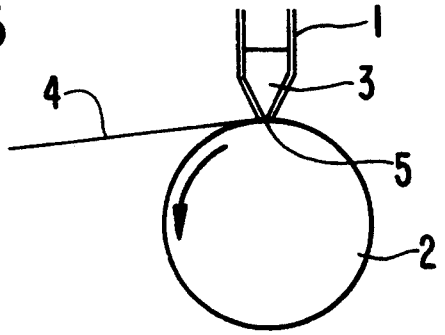
FIG. 3 is a schematic side view of a single-roll type rapid liquid quenching and solidifying apparatus which was utilized to produce preferred embodiments of the present high strength aluminum alloy.

Then, ingots were machined out of these button ingots, and they were put into a quartz tube 1 of the single-roll type rapid liquid quenching and solidifying apparatus illustrated in FIG. 3, respectively. The quartz tube 1 was provided with a fine hole 5 whose diameter was 0.3 mm, and it was placed on top of a roll 5 made of copper at a clearance of 0.5 mm. After the ingots were melted by radio-frequency heating in the quartz tube 1, the molten aluminum alloys 3 were spouted at a spouting pressure of 1 kgf/cm$^2$ onto the copper roll 5 which was rotated at a speed of 4,000 rpm, respectively, thereby rapidly quenching and solidifying the molten aluminum alloys 3. Thus, ribbons 4 were produced in a width of about 1 mm and in a thickness of about 20 micrometers.

The resulting ribbons 4 were subjected to an X-ray diffraction analysis. According to the results of the X-ray diffraction analysis, all of the ribbons 4 exhibited the diffraction peaks in "αAl" only, and accordingly they did not include the intermetallic compounds.

Further, the resulting ribbons 4 were subjected to a differential thermal analysis. According to the results of the differential thermal analysis, all of the ribbons 4 made from Examples 1 through 8 showed an exothermic reaction, and accordingly the amorphous phases were verified to be present therein. However, the ribbons 4 made from Examples 9 through 13 showed no exothermic reaction. As a result, the ribbons 4 made from Examples 1 through 8 were found to include the mixed phase of the amorphous phases and the microcrystalline phases, and the ribbons 4 made from Examples 9 through 13 were found to include the microcrystalline phases only. Furthermore, all of the ribbons 4 made from Examples 1 through 8 were verified to include the amorphous phases in a volume content of less than 50% by analyzing their differential thermal analysis curves.

Moreover, the resulting ribbons 4 were subjected to a tensile strength test by using an "Instron" tensile strength testing machine. The results thus obtained are also set forth in Table 2 above.

The ribbons 4 made from Comparative Example 14 were verified that they were was made from the mixed phase which included the amorphous phases in a volume content of less than 50%. However, it is readily appreciated from Table 2 that the ribbons 4 made from Comparative Example 14 had a heavier specific gravity and had a tensile strength which was not so large particularly because they included the "Mm" and Fe in such large contents. It is apparent from Table 2 that the ribbons 4 made from Comparative Example 15 had a lighter specific gravity because they included the "Mm" and Fe in such lesser contents. However, in the ribbons 4 made from Comparative Example 15, the structures were reinforced less by forming less solid solutions including the "Mm" and Fe. This ribbons 4 made from Comparative Example 15 were verified that they were made from the crystalline phases. Consequently, the ribbons 4 made from Comparative Example 15 had such a low tensile strength.

Figure 2:
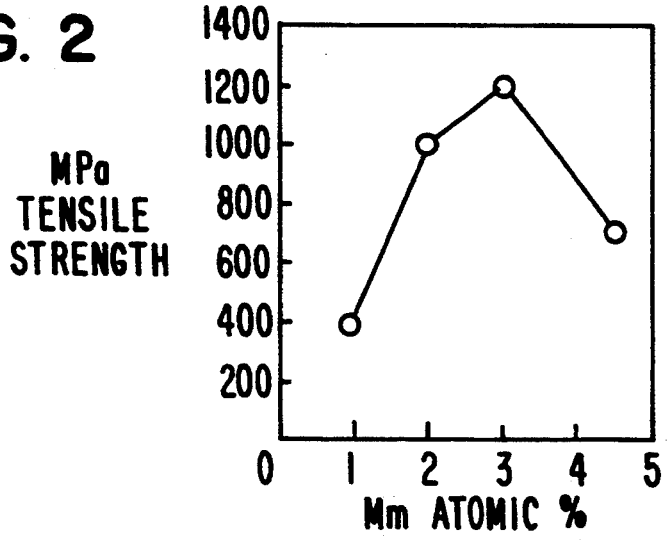
FIG. 2 is a line chart which illustrates the relationship between the contents of the "Mm" and the tensile strengths of preferred embodiments of the present high strength aluminum alloy, preferred embodiments which are expressed by a formula $AlMm_{1-4.5}Fe_1$ on the basis of atomic %, i.e., Al-1 to 4.5 atomic % Mm-1 atomic % Fe.

On the other hand, the ribbons 4 made from Examples 1 through 13 of the present high strength aluminum alloy had a specific gravity as less as 2.9, and they had a large tensile strength of from 950 to 1,120 MPa. Thus, the advantageous effects according to the present invention could be verified. In addition, as illustrated in FIG. 2, a line chart illustrating the relationship between the contents of the "Mm" and the tensile strengths of the preferred embodiments of the present high strength aluminum alloy, the preferred embodiments had a large tensile over the claimed "Mm" content range. Here, the preferred embodiments were expressed by a formula $AlMm_{1-4.5}Fel$ on the basis of atomic %, i.e., Al-1 to 4.5 atomic % Mm-1 atomic % Fe.

Having now fully described the present invention, it will be apparent to one of ordinary skill in the art that many changes and modifications can be made thereto without departing from the spirit or scope of the present invention as set forth herein including the appended claims.

Figure 1:
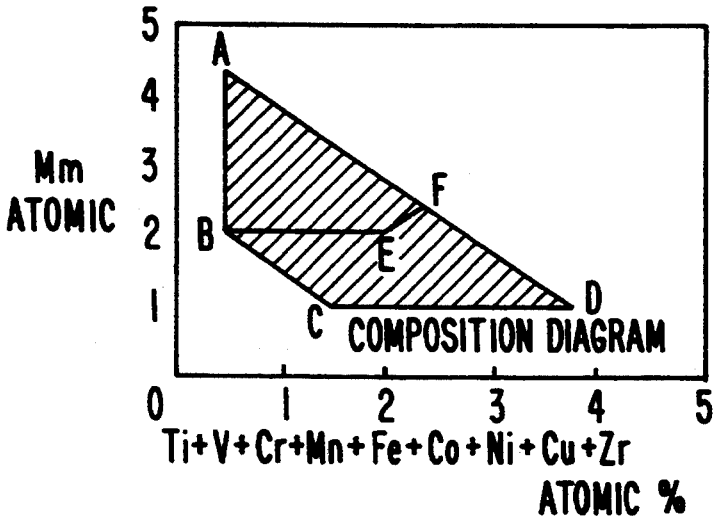
FIG. 1 is a composition diagram which specifies the content ranges of the "Mm" and the transition metal "X" in the high strength aluminum alloy according to the present invention.

What is claimed is:

1. A high strength aluminum alloy expressed by a general formula, $Al_aX_bMm_c$, in which:

"X" stands for at least one transition metal selected from the group consisting of Ti, V, Cr, Mn, Fe, Co, Ni, Cu and Zr;

"Mm" stands for a misch metal;

"a" stands for an aluminum content in a range of from 95.2 to 97.5 atomic %; and "b" and "c" stand for, respectively, the content of said transition metal and the content of said misch meal, each of which falls within the area delineated by the points A, B, C and D of FIG. 1 of the accompanying drawings;

said alloy having a structure including;

microcrystalline phases, or mixed phases containing amorphous phases in a volume content of less than 50% and the balance of microcrystalline phases; and said alloy having been produced by a rapid quenching and solidifying process.

2. The high strength aluminum alloy according to claim 1, wherein the content of said transition metal and the content of said misch metal each falls within the area delineated by the points A, B, E and F of FIG. 1 of the accompanying drawings.

3. The high strength aluminum alloy according to claim 1, wherein said high strength aluminum alloy has a specific gravity of 3.0 or less and a tensile strength of 900 MPa or mope.

4. The high strength aluminum alloy according to claim 1, wherein said mixed phases contain said amorphous phases in a content of from 5 to 30% by volume and the balance of said microcrystalline phases.

5. The high strength aluminum alloy according to claim 1, wherein said misch metal includes La and Ce as the principal components, the rare-earth elements other than La and Ce, and inevitable impurities.

6. The high strength aluminum alloy according to claim 5, wherein said misch metal includes Ce in an amount of from 45 to 54% by weight, La in an amount of from 23 to 32% by weight, Nd in an amount of from 13 to 19% by weight, Pr in an amount of from 3 to 8% by weight, and Fe in an amount of less than 1% by weight, and inevitable impurities in an amount of less than 1% by weight.

7. The high strength aluminum alloy according to claim 1, wherein said microcrystalline phases of said high strength aluminum alloy are reinforced by forming solid solutions including said misch metal and said transition metal.

8. The high strength aluminum alloy according to claim 1, wherein said high strength aluminum alloy is produced by a gun. process or a piston-anvil process which can produce thin tips having a weight of hundreds milligrams, a centrifugal process, a single roll process or a twin roll process which can produce thin strips continuously, a spray process which can produce powders, or a submerged rotary spinning process which can produce fine wires.

9. The high strength aluminum alloy according to claim 8, wherein said high strength aluminum alloy is produced by said single roll process, said twin roll process or said submerged rotary spinning process.

* * * * *